United States Patent [19]

Montet

[11] Patent Number: 4,920,463

[45] Date of Patent: Apr. 24, 1990

[54] LAMPHOLDER FOR AN AUTOMOBILE VEHICLE HEADLIGHT

[75] Inventor: Maurice Montet, Paris, France

[73] Assignee: Valeo Vision, Bobigny Cedex, France

[21] Appl. No.: 380,546

[22] Filed: Jul. 14, 1989

[30] Foreign Application Priority Data

Jul. 20, 1988 [FR] France ..... 88 09815

[51] Int. Cl.[5] ..... H01R 33/00

[52] U.S. Cl. ..... 362/61; 362/226; 313/318

[58] Field of Search ..... 362/61, 226; 313/318

[56] References Cited

U.S. PATENT DOCUMENTS 4,614,997 9/1986 Montet .
4,670,822 6/1987 Baker ..... 362/226

FOREIGN PATENT DOCUMENTS 2377001 8/1978 France .
2555824 5/1986 France .
2604132 3/1988 France .
1396792 6/1975 United Kingdom .
2064747 6/1981 United Kingdom .

*Primary Examiner*—Allen M. Ostrager
*Attorney, Agent, or Firm*—Wenderoth, Lind & Ponack

[57] ABSTRACT

A lampholder, for mounting a lamp in an opening of a reflector in a headlight for an automotive vehicle, includes a ring having structure for mounting the ring in the reflector opening and locating elements for locating the lamp in the ring in a position which is predetermined both axially of the lamp and rotationally around the lamp axis. The lamp holder also has structure whereby the lamp can be secured removably in this position. This securing structure includes a radially extending tongue and a locking finger diametrically opposite the tongue, both being formed integrally with the lampholder ring. The tongue is hinged on the ring and has a longitudinal profile such that, when it is swung about its hinge so as to overlie a diameter of the ring, it covers a part of the lamp and is held in position by the locking finger. In this position the tongue is resiliently deformed so as to exert a spring biassing force on the lamp and thus to hold the latter firmly in position.

9 Claims, 2 Drawing Sheets

LAMPHOLDER FOR AN AUTOMOBILE VEHICLE HEADLIGHT

FIELD OF THE INVENTION

This invention is generally concerned with the mounting of a lamp in an opening at a base of the reflector of a headlight for an automotive vehicle, and is particularly directed to an improved form of lampholder for this purpose.

BACKGROUND OF THE INVENTION

One example of a lampholder of conventional construction is described in U.S. Pat. No. 4,694,997 and its corresponding French Patent Specification 2 555 824. This known lampholder comprises: a ring, which may for example be made of plastics material, and which is adapted to be fixed in or on the reflector opening, means such as projections or depressions which allow the lamp to be located in a position which is prdetermined both axially and circumferentially, or rotationally about the axis of the lamp, and removable securing means for the lamp, which conventionally comprise a clip, generally of "U" or similar shape and formed of spring wire, the clip being hinged on the ring at one end and being such that it can be hooked onto the ring at its other end, so as to engage on the lamp and hold it in position.

A lampholder of the above known kind does however have the disadvantage that two separate elements, made of different materials and by different methods, have to be manufactured and mounted one on the other. In addition, it is extremely complicated to use the same lampholder, of this type, in connection with lamps of different types.

SUMMARY OF THE INVENTION

An object of the present invention is to overcome these disadvantages, by providing a lampholder which can be made, and mounted, in an extremely economic manner.

Another object of the invention is to provide a lampholder which is readily adapted for use with lamps of different types.

To this end, according to the invention, a lampholder, especially a lampholder for mounting a lamp in a reflector opening of an automotive vehicle headlight, and being of the kind comprising a ring, mounting means for mounting the ring in the reflector opening, locating means for locating the lamp in the said ring in a position which is predetermined both axially and circumferentially about the axis of the lamp, and securing means for securing the lamp, thus positioned, removably in the ring, is characterised in that the securing means comprise a radially extending tongue and a locking finger for locking the tongue, the tongue and the locking finger being diametrically opposed to each other with respect to the ring and formed integrally with the latter, the tongue being hinged on the ring and having a longitudinal profile such that, when it is moved into a position over a diameter of the ring so as to cover a portion of the lamp, the tongue is maintained in that position by the locking finger, and is resiliently deformed so as to hold the lamp firmly in position due to the resilient biassing force caused by the deformation of the tongue.

Preferred features of the lampholder according to the invention includes the following:

(i) The longitudinal profile of the tongue may be in the form of a shallow "V", the apex of which is directed towards the lamp (ii) The tongue may exert its biassing force on a base member of the lamp.

(iii) The tongue may have a substantially central opening for surrounding a base member of the lamp.

(iv) The locking finger may extend generally perpendicularly to the plane of the lampholder ring, and has a cranked portion below which the tongue can be hooked by means of one edge of an opening formed in the tongue close to the free end thereof.

(v) The mounting means for the ring may comprise a set of resilient fingers formed in cavities defined in the ring, the fingers having teeth for engaging lockingly in holes formed in a collar member of the reflector opening.

(vi) The lampholder may further include an adaptor member which is arranged to be mounted in the ring in place of a lamp of a first type and to receive a lamp of a second type, where the lamp of the second type is one which is held in place by a portion of the lamp having different dimensions and a different position from those of the corresponding portion of the lamp of the first type. The lampholder also has a removable compensation element between the tongue and the lamp of the second type.

(vii) The compensation element, where provided, may comprise a clip made of resilient metallic wire and mounted in the tongue, the clip comprising a lamp engaging portion for engaging against the lamp, and at least one branch which extends into a passage formed in the tongue. Alternatively, the compensation element may comprise a second tongue which is hinged on the ring in a position lying intermediately between the hinge of the first tongue and the locking finger.

According to yet another preferred feature of the invention, the lampholder is formed by moulding it from two plastics materials having different degrees of flexibility, and the hinge of the tongue, or of each tongue as the case may be, the locking finger, and the mounting means for mounting the ring in the reflector, are formed of the more flexible of the two plastics materials.

Further aspects, objects and advantages of the present invention will appear more clearly from a reading of the detailed description which follows, and which describes preferred embodiments of the invention, being given by way of examply only and with reference to the accompanying drawings.

DESCRIPTION OF PREFERRED EMBODIMENTS OF THE INVENTION

Figure 1:
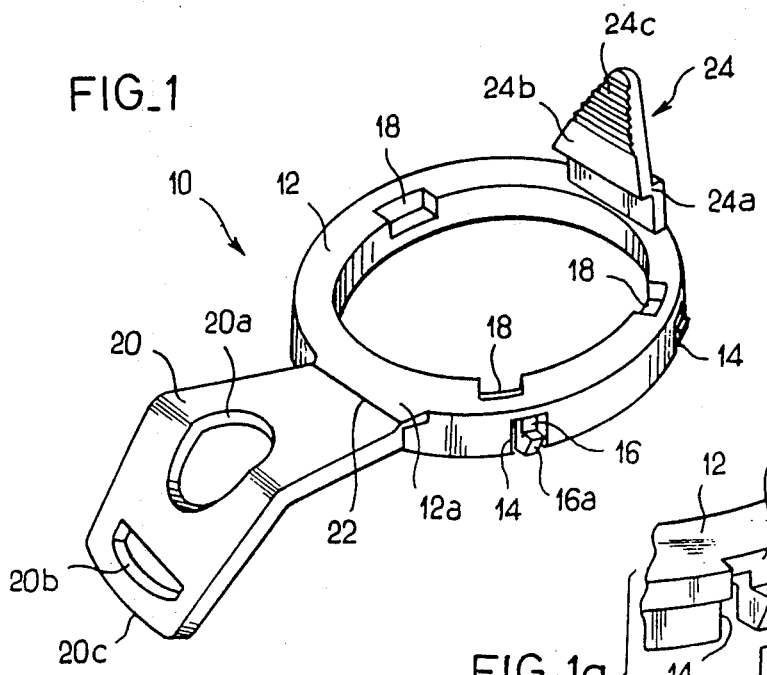
FIG. 1 is a perspective view of a lampholder of one embodiment of the invention.

Referring first of all to FIG. 1, a lampholder 10 in accordance with the invention comprises a single member, moulded in one piece and comprising a portion in the form of a ring 12, the cross section of which is essentially rectangular. In three cavities 14, formed in the outer surface of the ring, three fingers 16, two of which can be seen in FIG. 1, are provided. The fingers 16 are directed downwardly, and each finger has a locking tooth 16*a* in the lower part of its outer face.

Figure 1A:
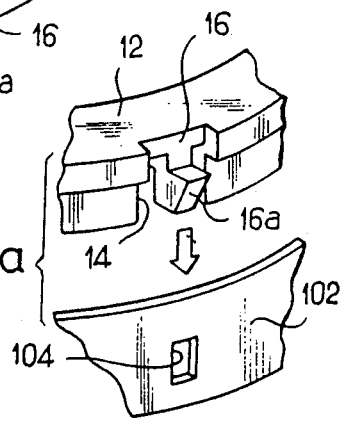
FIG. 1*a* is a partial perspective view on a larger scale showing a detail of the lampholder of FIG. 1.

In association with the above, and as is shown in FIG. 1*a*, a collar member 102 defining an opening which is formed in the base of a reflector in a conventional manner incorporates three holes 104, into which the teeth 16*a* engage by a resilient snapping action. In this way, the lampholder is anchored firmly and without play in its associated reflector.

The lampholder 10 is, in this example, especially adapted for use with a normal lamp of the $H_4$ type, and to this end it is provided with three cavities 18 in the upper surface of the ring 12. The cavities 18 extend from the inside over part of the width of the ring 12, with predetermined dimensions and at circumferential positions. The cavities 18 are arranged to receive the three projecting lugs which are provided on the peripheral edge of the base member of such an $H_4$ lamp (not shown), so as to position the latter both axially and in angular orientation.

In accordance with an important feature of the invention, the locking means for locking the lamp in position comprise a tongue 20 which is formed integrally with the ring 12 and which is attached in a hinged manner to one of the edges of the latter. More precisely, the ring 12 has a lateral extension 12*a* to which the tongue 20 is connected through a hinge 22, of the kind which may be called a "film hinge", formed by giving the material a much reduced thickness along a line. In the open position shown, the tongue 20 has a longitudinal profile which is generally in the form of a shallow V, so that the tongue is of bent form. It has a central opening 20*a* which is substantially circular, together with a transverse locking opening 20*b* close to its free end. The outer edge 20*c* of the tongue 20 and the edge of the opening 20*b* adjacent thereto are slightly rounded as shown.

In a region of the ring 12 diametrically opposed to the hinge 22 is, a locking finger 24, again integral with the ring 12, that extends essentially vertically upwardly. It has an inwardly directed cranked portion 24*a* at a height which is about equal to the thickness of the tongue 20, together with an actuating end portion 24*b* of substantially triangular form. Anti-slip ribs 24*c* are formed on the surface of the actuating portion 24*b* which faces towards the inside of the ring.

The lampholder, as described above, is used in the following manner. It is first of all fitted into the reflector collar member 102, in which it is then held by the resilient action of the fingers 16. The tongue 20 is then in the open position as shown, and the $H_4$ lamp (not shown) is fitted in the manner indicated above. The locking tongue 20 is then swung over the lamp, by pivoting action about its hinge 22, in such a way that the opening 20*a* then surrounds the base member of the lamp, with the opening 20*b* surrounding the locking finger 24. By pushing the free end of the tongue 20 towards the base of the finger 24, the latter is resiliently deformed until the tongue 20 is firmly anchored below the cranked portion 24*a*, by means of the inner edge of the opening 20*b* in the tongue. The cranked portion of the finger 24 in its normal position maintains the tongue 20 securely locked in this position.

It is to be understood that these operations lead to flattening of the tongue 20 from its V-shaped longitudinal profile shown, by engagement of the apex of the "V" against the base member of the lamp. This resilient deformation of the tongue sets up a biassing force having the effect of a spring, which is directed downwardly and which holds the lamp firmly in its predetermined position.

In order to obtain the various resilient characteristics referred to above, the lampholder should of course be made in a material having appropriate properties. Particularly suitable materials are thermoplastics. However, according to another feature of this invention, during moulding of the lampholder it is preferably given properties of rigidity and elasticity which differ from one part of the lampholder to another. In particular, it is especially advantageous if the body of the ring 12 and the body of the tongue 20 are formed of a plastics material which is reinforced, for example with glass fiber. This has the effect of increasing the thermal stability of the ring, which is subjected to elevated temperatures in the neighbourhood of the lamp, while at the same time the magnitude of the biassing force exerted by the tongue 20, when deformed against the base member of the lamp, is increased. The lamp is thus held perfectly fixed with respect to the reflector, regardless of vibrations inherent in the mounting of the lamp in a vehicle. On the other hand, the fingers 16, the hinge 22, and the locking finger 24 are preferably made of the same plastics material, but are not reinforced.

In this way, fitting of the lampholder in the reflector, and its separation therefrom, are facilitated. Bending of the tongue about its hinge is also facilitated, as is the locking of the tongue 20 on the locking finger 24. The effects of fatigue in the hinge, resulting from repeated use, are also reduced. In connection with the locking of the tongue 20 on the finger 24, the tongue is of course relatively rigid, and the finger 24 must therefore be made in such a way that it can easily be deformed resiliently outwardly when the end of the tongue is being pushed down towards the base of the finger 24. Similarly, unlocking of the tongue 20 is facilitated by pushing the actuating portion 24*b* of the finger outwardly.

Preferably, moulding of the lampholder of two materials, as discussed above, is achieved by carefully arranging in the mould appropriate feed openings for reinforced material and feed openings for nonreinforced material.

Figure 3:
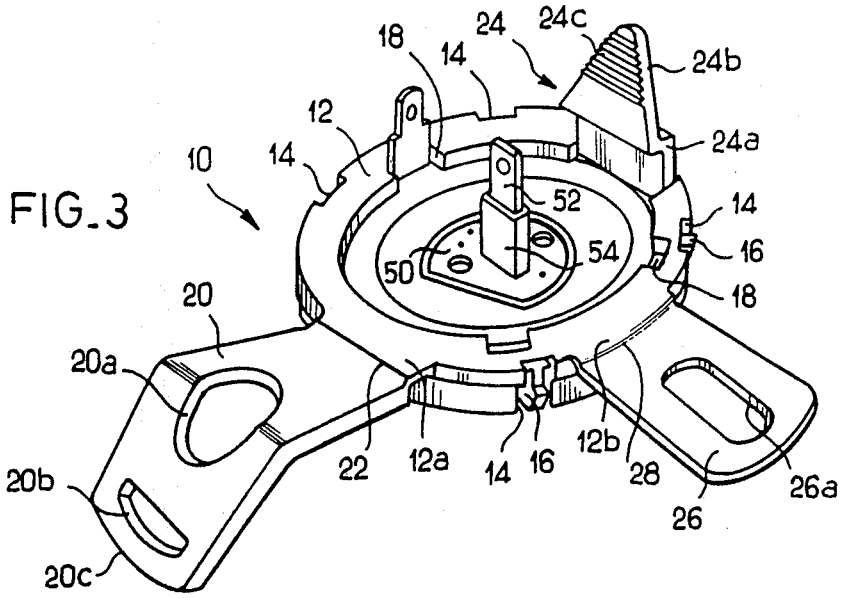
FIG. 3 is a perspective view of a second modified embodiment of the invention.
Figure 2:
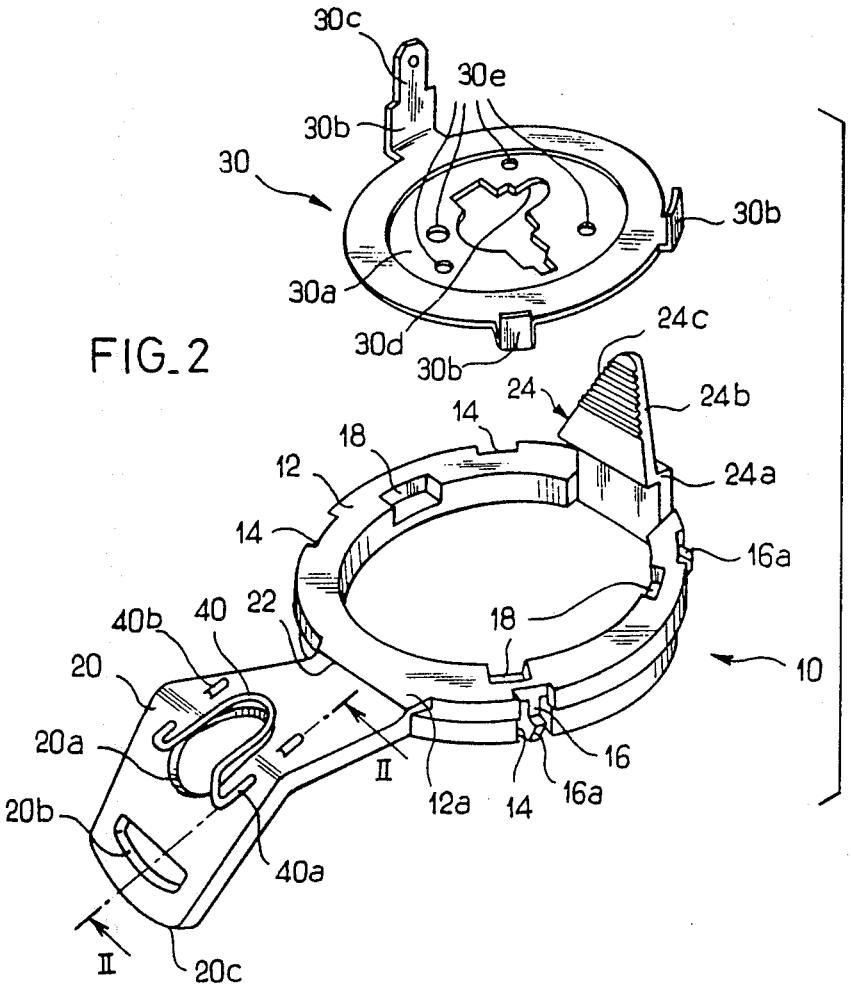
FIG. 2 is an exploded perspective view of a lampholder with an adaptor, of a first modification of the invention.
Figure 2A:
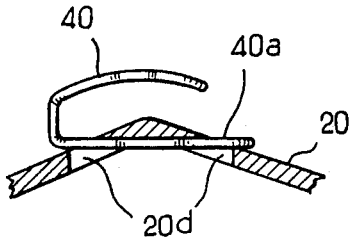
FIG. 2*a* is a view in cross section taken on the line II— II in FIG. 2.

FIGS. 2, 2*a* and 3 show further embodiments of the invention. In these Figures, elements or parts which are identical or similar to those in FIG. 1 are designated by the same reference numerals, and will not be described again.

In the embodiment shown in FIG. 2, the same lampholder base structure is used regardless of whether the lamp is a normal lamp of the $H_4$ type of a normal lamp of the $H_1$ type. To this end, an adaptor element 30 is provided. Preferably the adaptor 30 is a sheet metal pressing, appropriately stamped and bent, which is so configured that it can itself be fitted in a mounting adapted to accommodate an $H_4$ lamp. For this purpose, the adaptor 30 has a circular base 30*a*, the diameter of which is substantially equal to that of the base member of an $H_4$ type lamp, with three projecting lugs 30*b* which are adapted to nest in the cavities 18, together with a central opening 30*d* and holes 30*e* which are specially located to enable a normal lamp of the $H_1$ type to be mounted in a them in known manner. One of the projecting lugs 30b, indicated at 30c, serves as an earth or ground connection terminal.

In accordance with a feature of this embodiment, due to the fact that (a) the surface of the base member of the lamp on which the locking tongue 20 must engage, in order to exert its holding force on it, is offset (downwardly in the Figures) as compared with the surface of the base member of an $H_4$ lamp, and (b) the lamp base member is small in size and accurately centered with respect to the axis of the lamp, the tongue 20 is provided with a clip 40, preferably made of spring steel, which is generally of a U-shape having branches 40a and 40b are bent downwardly on themselves. The bent portions of the branches 40a, 40b are inserted in passages 20d formed through the tongue 20 (FIG. 2a) on either side of the circular opening 20a. That portion of the "U" of the clip 40 which is situated above the level of the opening 20a in the position shown, exerts a holding (biassing) force on the base member of the $H_1$ lamp when the tongue 20 is swung over and secured in position in the manner described above. As is shown in FIG. 2a, the working part of the clip 40 is slightly curved, in order to optimise the centering of the holding force on the lamp.

Thus, in this embodiment, the resilient biassing or holding force which holds the lamp firmly in place results from the combination of a resilient deformation of the tongue 20 and a resilient deformation of the clip 40.

The lampholder in the embodiment of FIGS. 2 and 2a can of course again be made, advantageously, of two different materials in the same way as has been described above.

When it is desired to use the lampholder of FIG. 2 with a normal $H_4$ lamp, all that is necessary is to omit the adaptor 30 and clip 40, and the lampholder is then substantially identical to that of FIG. 1 apart from the fact that the passages 20d are present.

Referring now to FIG. 3, there is shown a second variant of a lampholder according to the invention, in which the lampholder is adapted for use with a lamp of the $H_1$ type. For this purpose it has the adaptor element 30 already described, together with a second tongue 26 formed integrally with the ring 12, to which the tongue 26 is connected through a film hinge 28 at the end of a small extension 12b of the ring 12. The tongue 26 is preferably arranged at a circumferential position halfway between the tongue 20 and the locking finger 24, that is to say it extends at about 90° with respect to each of the elements 20 and 24. The tongue 26 has an opening 26a, the dimensions of which are smaller than those of the opening 20a but preferably slightly greater than the dimensions of an insulating base 54 of a supply terminal 52 for an $H_1$ lamp.

The lampholder of FIG. 3, described above, is used in the following manner. The lamp (the base member 50 of which is shown in FIG. 3) and its adaptor 30 are fitted into the ring 12, the latter having previously been mounted in the back of the reflector. The tongue 26 is then swung upwardly and through about 180° about its hinge 28, in such a way that its opening 26a then surrounds the insulating base element 54. The tongue 20 is then also moved over and locked in the manner described with respect to FIG. 1.

The tongue 26 plays a part similar to that of the clip 40 in FIG. 2, taking the place of a spacer so as to compensate for the axial offset, relative to the equivalent position for an $H_4$ lamp, of the surface against which the biassing force is exerted on the lamp to hold it in place. The tongue 26 also allows the tongue 20, which is generally similar to that of FIG. 1, to exert its holding force conveniently on the back of the small base member 50 of the lamp, and not simply on the adaptor 30. It should be noted that the adaptor 30 is held in place by virtue of the fact that it is the base member 50 which takes the holding or biassing force, without any need for any auxiliary fixing means to be provided.

It will be clear that, if it is desired to use a lampholder of this kind with a normal $H_4$ lamp, it is merely necessary to omit the adaptor 30 and the tongue 26. The latter can be omitted either by blocking off the corresponding portion of the mould during moulding, or by removing the tongue itself from the ring 20, but cutting through the hinge 28. It is of course also possible, though less preferable, to keep the tongue 26, merely leaving it in the unused position shown in FIG. 3.

In the case in which the lampholder is made of two materials, it is advantageous to form the tongue 26 of a reinforced plastics material, which confers on it a degree of rigidity appropriate to good transmission of the holding force exerted by the tongue 20, while the hinge 28 is formed of an nonreinforced region of the plastics material, for the same reasons as have been explained above in connection with the hinge 22.

What is claimed is:

1. A lampholder for mounting a lamp in an opening of a reflector for an automotive vehicle headlight, the lampholder comprising a ring, mounting means for mounting said ring in the opening of the reflector, said ring defining locating means for locating a lamp on said ring in a position predetermined both axially and circumferentially, and securing means for securing the lamp removably in said ring in said location, said securing means comprising a radially extending tongue and a locking finger for said tongue, diametrically opposed to each other and formed integrally with said ring, said tongue being hinged on said ring and having a longitudinal profile such that, when it is moved into a position diametrically overlying said ring, it covers a portion of the lamp, said tongue further comprising means for engaging said locking finger to thereby retain said tongue removably in said position, said tongue being resiliently deformable to thereby, when thus retained in said position, hold the lamp firmly in position by virtue of a biassing force resulting from deformation of said tongue.

2. A lampholder according to claim 1, wherein said tongue has a substantially central opening for surrounding a base member of the lamp.

3. A lampholder according to claim 2, wherein said tongue has a longitudinal profile in the form of a shallow "V", the apex of which is directed towards the lamp.

4. A lampholder according to claim 3, wherein said tongue is so configured as to exert said biassing force on a base member of the lamp.

5. A lampholder according to claim 4, wherein said locking finger extends generally perpendicularly with respect to plane of the said ring and has an intermediate cranked portion, said tongue having an opening formed close to its free end for engaging with said locking finger below said cranked portion thereof.

6. A lampholder according to claim 4, wherein said mounting means for mounting said ring in the reflector comprises a set of resilient fingers formed in cavities defined in said ring, each resilient finger having a tooth for engaging in a corresponding hole formed in a collar member defining the reflector opening, whereby to anchor said ring in the collar member.

7. A lampholder according to claim 4, further comprising an adaptor member having means for mounting the adaptor member in said ring in place of a lamp of a first type and means for receiving a lamp of a second type, where the lamp of the second type is one comprising a retaining portion for holding the lamp of the second type in position, with the retaining portion being differently dimensioned and positioned from a corresponding portion of a lamp of the first type, said lampholder further comprising a removable compensation element and means mounting said compensation element with respect to said ring in such a way that said compensation element can be placed between said tongue and a said lamp of second type.

8. A lampholder according to claim 7, wherein said compensation element comprises a clip of resilient metallic wire, said tongue having a clip holding passage formed therein, said clip comprising a lamp engaging portion and at least one branch extending into said passage so that said clip is mounted on said tongue.

9. A lampholder according to claim 7, wherein said compensation element comprises a second tongue, and hinge means hinging said second tongue on said ring intermediate between said hinge of the first said tongue and said locking finger.

* * * * *